US011476066B2

(12) United States Patent
Hofsaess

(10) Patent No.: US 11,476,066 B2
(45) Date of Patent: Oct. 18, 2022

(54) TEMPERATURE-DEPENDENT SWITCH

(71) Applicant: Marcel P. Hofsaess, Steintahleben (DE)

(72) Inventor: Marcel P. Hofsaess, Steintahleben (DE)

( * ) Notice: Subject to any disclaimer, the term of this patent is extended or adjusted under 35 U.S.C. 154(b) by 22 days.

(21) Appl. No.: 17/025,862

(22) Filed: Sep. 18, 2020

(65) Prior Publication Data

US 2021/0090835 A1 Mar. 25, 2021

(30) Foreign Application Priority Data

Sep. 20, 2019 (DE) ..... 10 2019 125 453.1

(51) Int. Cl.
*H01H 37/72* (2006.01)
*H01H 37/54* (2006.01)
(Continued)

(52) U.S. Cl.
CPC ..... *H01H 37/72* (2013.01); *H01H 37/04* (2013.01); *H01H 37/5409* (2013.01);
(Continued)

(58) Field of Classification Search
CPC .... H01H 37/72; H01H 37/04; H01H 37/5409; H01H 37/64; H01H 2037/528; H01H 2037/5481
(Continued)

(56) References Cited

U.S. PATENT DOCUMENTS 3,582,853 A 6/1971 Morris
4,117,443 A * 9/1978 Hofsass ..... H01H 37/5409 337/348
(Continued)

FOREIGN PATENT DOCUMENTS

DE 2046277 A 4/1971
DE 2508807 A1 9/1975
(Continued)

OTHER PUBLICATIONS

DE-102007063650-B4, Sep. 2011, Hofsaess M P, English translation (Year: 2011).*
(Continued)

*Primary Examiner* — Anatoly Vortman
(74) *Attorney, Agent, or Firm* — Reising Ethington, P.C.

(57) ABSTRACT

A temperature-dependent switch comprises a first stationary contact, a second stationary contact, and a temperature-dependent switching mechanism having a movable contact member. In its first switching position, the switching mechanism presses the contact member against the first contact and thereby produces an electrically conductive connection between the two contacts. In its second switching position, the switching mechanism keeps the contact member spaced apart from the first contact. The temperature-dependent switching mechanism further comprises first and second temperature-dependent snap-action parts which switch from geometric low-temperature configurations to geometric high-temperature configurations when exceeding first and second switching temperatures, respectively, and switch back when subsequently falling below first and second reset temperatures, respectively. Switching the first and/or the second snap-action part from its geometric low-temperature configuration to its geometric high-temperature configuration brings the switching mechanism from its first switching position to its second switching position.

18 Claims, 9 Drawing Sheets

(51) Int. Cl.
*H01H 37/64* (2006.01)
*H01H 37/04* (2006.01)
*H01H 37/52* (2006.01)

(52) U.S. Cl.
CPC ..... *H01H 37/64* (2013.01); *H01H 2037/528* (2013.01); *H01H 2037/5481* (2013.01)

(58) Field of Classification Search
USPC ..... 337/91, 335, 336, 370, 371
See application file for complete search history.

(56) References Cited

U.S. PATENT DOCUMENTS 4,325,047 A 4/1982 Inada et al.
4,393,834 A 7/1983 Doherty, Jr.
4,470,033 A * 9/1984 Hofsass ..... H01H 37/5427 337/365
4,849,729 A * 7/1989 Hofsass ..... H01H 37/5427 337/377
5,043,690 A * 8/1991 Wahls ..... H01H 37/54 337/342
5,721,525 A * 2/1998 Hofsass ..... H01H 1/504 337/380
5,898,555 A 4/1999 Katsumata et al.
6,133,817 A 10/2000 Hofsass et al.
7,663,467 B2 * 2/2010 Hsu ..... H01H 37/5409 337/380
2009/0115566 A1 5/2009 Hsu
2013/0021132 A1 * 1/2013 Kandhasamy ..... H01H 37/74 337/333
2013/0127586 A1 * 5/2013 Hofsaess ..... H01H 37/5427 337/365
2014/0225709 A1 8/2014 Kirch et al.
2015/0061818 A1 * 3/2015 Klaschewski ..... H01H 37/5427 337/343
2021/0090835 A1 * 3/2021 Hofsaess ..... H01H 37/5409

FOREIGN PATENT DOCUMENTS

DE 102007042188 B3 4/2009
DE 102007063650 A1 12/2009
DE 102013101392 A1 8/2014
DE 102013102006 A1 8/2014
EP 0041823 A1 12/1981
EP 0658911 A2 6/1995
EP 0951040 A2 10/1999

OTHER PUBLICATIONS

Search report issued by the European Patent Office for application EP20196506.8 dated Feb. 12, 2021.

* cited by examiner

TEMPERATURE-DEPENDENT SWITCH

CROSS REFERENCE TO RELATED APPLICATIONS

This application claims priority from German patent application DE 10 2019 125 453.1 filed on Sep. 20, 2019. The entire contents of this priority application are incorporated herein by reference.

BACKGROUND

This disclosure relates to a temperature-dependent switch.

An exemplary temperature-dependent switch is disclosed in DE 10 2007 063 650 B4.

Such temperature-dependent switches may be used in practice for the purpose of protecting electrical devices from overheating. To this end, the switch is usually connected in series to the device to be protected and to the supply voltage thereof and is arranged mechanically on the device such that it is thermally connected to the device.

A temperature-dependent switching mechanism ensures that the two stationary contacts of the switch are electrically connected to each other below the response temperature of the switching mechanism. Hence, the electric circuit is closed below the response temperature and the load current of the device to be protected can flow through the switch.

If the temperature rises above an admissible value, the switching mechanism lifts off the movable contact member from the counter contact, opening the switch and disconnecting the load current of the device to be protected. The now current-less device can cool down again. In this case, the switch, which is coupled thermally to the device, also cools down and would thereupon actually close again automatically.

The switch disclosed in DE 10 2007 063 650 B4 is a switch in which in addition to the usual switching mechanism a second switching mechanism is used, which switches at a higher switching temperature than the first switching mechanism. This additional, second switching mechanism serves on the one hand as a safety element which opens the switch even if, for example, the first switching mechanism is fatigued or has a malfunction for other reasons, or if a safety temperature is exceeded which is above the response temperature of the first switching mechanism.

The first switching mechanism is thus responsible for the usual opening and closing, whereas the second switching mechanism only becomes active when exceeding its own response temperature that is above the response temperature of the first switching mechanism. The second switching mechanism can also provide a so-called self-holding function. It keeps the switch open even if the first switching mechanism switches back to its low-temperature configuration and wants to close the switch when falling below its own reset temperature. The second switching mechanism can then prevent the switch from switching back.

The so-called self-holding function of the switch disclosed in DE 10 2007 063 650 B4 is caused by the fact that the second switching mechanism comprises a temperature-independent bistable spring part which holds the second switching mechanism and thus the switch in the open position even if the temperature-dependent snap-action part of the second switching mechanism switches back to its low-temperature configuration. Thus, a reset does not occur automatically in the cooling position of the switch. Therefore, the device to be protected cannot automatically switch itself on again after switching off.

This type of self-holding of the switch is a safety function designed to prevent damage, as is the case with electric motors used as drive units, for example.

The switch disclosed in DE 10 2007 063 650 B4 can thus only be closed again by mechanical manipulation from the outside, for example by bringing the temperature-independent bistable spring part back to its initial configuration by means of a targeted vibration or by applying pressure directly to the spring part from the outside.

However, such a reset of the switch that is caused mechanically from outside, is error-prone, since vibrations which can cause the switch to close can in principle also occur unintentionally, so that the switch may be closed again even if this is not intended. It is also a disadvantage having to reset the switch by hand, for example by inserting a bolt through the housing of the switch, with which a pressure is exerted on the temperature-independent bistable spring part. Through such openings in the housing, impurities can also penetrate into the interior of the switch, which in turn can impair its function.

Another switch with self-holding function is disclosed in DE 10 2013 101 392 A1. This switch comprises a single temperature-dependent switching mechanism having a temperature-independent bimetal snap-action disc and a bistable spring disc, which carries a movable contact or a current transfer member. When the bimetal snap-action disc is heated to a temperature above its response temperature, it lifts off the movable contact or current transfer member from one or two counter contacts against the force of the spring disc, and thereby forces the spring disc to its second stable configuration, in which the switching mechanism is in its high-temperature position. When the switch and thus the bimetal snap-action disc cool down again, the bimetal snap-action disc switches back to its first configuration. However, due to its design, it cannot be supported by a counter bearing, so that the spring disc remains in the configuration in which the switch is open.

The switch disclosed in DE 10 2013 101 392 A1 thus also remains in its open position after having opened once, even if it cools down again. However, tests carried out by the applicant have shown that this switch also closes again in the event of stronger mechanical vibrations such that—under safety aspects—it may not be the perfect solution in some applications.

It is also known to provide such temperature-dependent switches with a so-called self-holding resistor which is connected in parallel to the two stationary contacts of the switch so that it takes over a part of the load current when the switch opens. Ohmic heat, which is sufficient to hold the snap-action disc above its response temperature, is generated in the self-holding resistor.

A switch with such a self-holding action is disclosed in EP 0 951 040 B2. However, this type of self-holding action with a self-holding resistor connected in parallel to the switch is only active as long as the electric device is still turned on. As soon as the device is shut off from the supply circuit, no more current flows through the temperature-dependent switch either, so that the self-holding function is cancelled. After the electric device has been turned on again, the switch would therefore be in the closed state again so that the device can heat up again, which could lead to consequential damage.

Another temperature-dependent switch with self-holding function is disclosed in DE 10 2007 042 188 B3. This switch comprises a temperature-dependent, bistable snap-action disc as well as a temperature-independent, bistable spring disc. The spring disc is designed as a circular snap-action spring disc to which the movable contact member is centrally attached. In the low-temperature position of the switch, the movable contact member is pressed by the snap-action spring disc against the first stationary contact, which is arranged on the inside of a cover of the housing. The snap-action spring disc presses by way of its edge against an inner bottom of a lower part of the housing, which acts as the second contact of the switch. In this way, the snap-action spring disc, which itself is electrically conducting, produces an electrically conductive connection between the two stationary contacts of the switch.

In its low-temperature position, the bimetal snap-action disc lies loosely against the movable contact. If the temperature of the bimetal snap-action disc increases, it switches to its high-temperature position, in which it presses with its edge against the inside of the lower part of the housing, and presses thereby with its center onto the snap-action spring disc such that the snap-action spring disc switches from its first to its second stable configuration, as a result of which the movable contact member is lifted off from the stationary contact and the switch is opened.

If the temperature of the switch cools down again, the bimetal snap-action disc switches back to its low-temperature position again. In this case, it moves with its edge into abutment with the edge of the snap-action spring disc and with its center into abutment with the upper part of the housing. However, the actuating force of the bimetal snap-action disc is not sufficient to let the snap-action spring disc switch back to its first configuration again.

The bimetal snap-action disc only bends further once the switch has cooled down a lot such that it is finally able to press the edge of the snap-action spring disc onto the inner bottom of the lower part by such a distance that the snap-action spring disc switches to its first configuration again and closes the switch again.

The switch disclosed in DE 10 2007 042 188 B3 therefore, after having opened, remains open until it has cooled down to a temperature below room temperature, for which purpose a cooling spray can be used, for example.

Although this switch meets the relevant safety requirements in many applications, it has nevertheless been shown that as a result of bracing the bi-metal snap-action disc between the upper part of the housing and the edge of the snap-action spring disc, in rare cases the snap-action spring disc nevertheless springs back in an unwanted manner. Moreover, in practice it is relatively difficult, or at least only possible at great expense, to produce a bimetal snap-action disc with such thermal behavior. On the one hand, the bimetal snap-action disc must exhibit a very precise switching behavior when the switching temperature is reached, and on the other hand, it must bend even more in its low-temperature configuration when reaching a temperature below room temperature than it already did when reaching its reset temperature and switching back to its low-temperature configuration.

In this case, the bimetal snap-action disc has three functions: 1. a snap-over to its high-temperature configuration when its switching temperature is reached, 2. a snap-back to its low-temperature configuration when the reset temperature is reached, and 3. an even stronger deflection when further cooling down below room temperature.

For this purpose, the thermal hysteresis behavior of the bimetal snap-action disc must be designed over a very wide temperature range. Guaranteeing this together with a precise switching behavior is only possible with great effort.

SUMMARY

It is an object to provide a temperature-dependent switch that overcomes the above-mentioned disadvantages. It is particularly an object to provide a temperature-dependent switch with a self-holding function that is simple from a structural point of view and not susceptible to mechanical vibrations.

According to an aspect, a temperature-dependent switch is provided that that comprises a first stationary contact, a second stationary contact, and a temperature-dependent switching mechanism having a movable contact member. The switching mechanism, in a first switching position, presses the movable contact member against the first contact and thereby produces an electrically conductive connection between the first stationary contact and the second stationary contact via the movable contact member and, in a second switching position, keeps the movable contact member spaced apart from the first stationary contact. The switching mechanism comprises a first temperature-dependent snap-action part which is configured to switch from a first geometric low-temperature configuration to a first geometric high-temperature configuration when exceeding a first switching temperature, and to switch from the first geometric high-temperature configuration back to the first geometric low-temperature configuration when subsequently falling below a first reset temperature. The switch further comprises a second temperature-dependent snap-action part which is configured to switch from a second geometric low-temperature configuration to a second geometric high-temperature configuration when exceeding a second switching temperature, and to switch from the second geometric high-temperature configuration back to the second geometric low-temperature configuration when subsequently falling below a second reset temperature. Switching the first snap-action part from the first geometric low-temperature configuration to the first geometric high-temperature configuration and/or switching the second snap-action part from the second geometric low-temperature configuration to the second geometric high-temperature configuration brings the switching mechanism from a first switching position to a second switching position. The second reset temperature is lower than the first reset temperature. The second snap-action part is configured to keep the contact member spaced apart from the first contact even if the switch has heated above the first switching temperature and the second switching temperature and has subsequently cooled down to a temperature between the first reset temperature and the second reset temperature.

With the herein presented switch, the switching operation, which causes the switch to open and thus causes a disconnection of the electric circuit, can thus be caused by both the first and the second snap-action part. The two snap-action parts can therefore be designed in such a way that they switch from their respective low-temperature configuration to their respective high-temperature configuration when similar switching temperatures are reached.

The first switching temperature (switching temperature of the first snap-action part) and the second switching temperature (switching temperature of the second snap-action part) can thus be located in a similar temperature range. The switch is thus opened in any case when one of the two switching temperatures is reached.

The self-holding function is effected by the additional second snap-action part. This second snap-action part keeps the movable contact member spaced apart from the first stationary contact even if the switch, after having opened, cools down again below the reset temperature of the first snap-action part (first reset temperature) and the first snap-action part thereby switches back to its low-temperature configuration. In this case, the first snap-action part tries to move the movable contact member back to the first stationary contact of the switch in order to close the switch. However, this is prevented by the second snap-action part, reset temperature of which (second reset temperature) is lower than the reset temperature of the first snap-action part, since the second snap-action part is then still in its high-temperature configuration, in which it keeps the movable contact member away from the first stationary contact against the force of the first snap-action part.

Even mechanical vibrations cannot cause the second snap-action part to snap over in the event that the switch, after having opened, has cooled down to a temperature between the first and the second reset temperature. The switch and thus the electric circuit is only closed again when the switch and thus the second snap-action part has cooled down to a temperature below the second reset temperature. Only then does the second snap-action part switch back to its low-temperature position, thereby pressing the movable contact member against the first stationary contact and closing the electric circuit.

The presented switch is thus a switch with a reversible self-holding function.

However, in contrast to the switch disclosed in DE 10 2007 063 650 B4, the self-holding function can be cancelled more easily, namely by cooling the switch to a temperature below the second reset temperature. A mechanical reset of the second snap-action part, as suggested for the switch disclosed in DE 10 2007 063 650 B4, is not necessary.

The herein presented switch is also advantageous compared to the switch disclosed in DE 10 2007 042 188 B3. In contrast to this already known switch, the self-holding function is not effected by one and the same (single) snap-action part, which must also cause the switch to open. Instead, in the herein presented switch, the opening of the switch can be effected by the first snap-action part, whereas the self-holding function is effected by the second (extra) snap-action part.

Thus, the switching hysteresis of the second snap-action part of the switch can also be designed over a similarly wide temperature range as the switching hysteresis of the single snap-action part of the switch disclosed in DE 10 2007 042 188 B3. However, the second snap-action part of the herein presented switch does not have to exhibit such an exact switching behavior, since the accuracy of the switching behavior of the switch can be guaranteed by the first snap-action part. The two snap-action parts of the switch can therefore be designed much more easily and produced more cost-effectively than the single snap-action part, which must take over both the switching and the self-holding function in the known switch.

According to a refinement, the second switching temperature is equal to or higher than the first switching temperature.

In other words, the two snap-action parts of the switch are designed in such a way that the switching temperature of the second snap-action part, which is substantially responsible for the self-holding function, is equal to or higher than the switching temperature of the first snap-action part.

If the first switching temperature is the same as or at least similar to the second switching temperature, both snap-action parts switch from their low-temperature configuration to their respective high-temperature configuration simultaneously or at least more or less simultaneously when the switch is heated. However, it is more or less indifferent which of the two snap-action parts switches first, since in this case the switch is opened as desired anyway.

However, the two snap-action parts can also be designed in such a way that the switching temperature of the second snap-action part is higher than the switching temperature of the first snap-action part. In this case, the first snap-action part is responsible for opening the switch, as the switch is already opened upon reaching the first switching temperature. This particularly has the advantage that the first snap-action part, the switching hysteresis of which is designed for a smaller or narrower temperature range than the switching hysteresis of the second snap-action part, can be designed with less effort to provide a precise switching behavior upon exactly reaching the switching temperature (first switching temperature).

The switching temperature of the second snap-action part, i.e. the second switching temperature, can, for example, be designed in the range of the overshoot temperature of the switch. However, the second switching temperature does then not have to be designed so exactly to an exact value required for safety reasons.

The "overshoot temperature", in the range of which the second switching temperature can be located, is typically the temperature or the temperature range to which the switch typically increases to a maximum after it is switched off. Normally, the temperature will still slightly overshoot after the switch is switched off, even if the switch is already open, because the switch will continue to heat up due to the residual heat.

In a further refinement of the switch, the second reset temperature is lower than room temperature, in particular lower than 15° C.

This has the advantage that, after having opening once in a normal environment with room temperature (17-23° C.), the switch does not automatically reset and close the electric circuit of the device to be protected. An inadvertent reset is thereby impossible.

In this case, the switch can only be closed again by (intentional) external exposure to cold. In principle it is also possible to design the second snap-action part in such a way that its reset temperature, i.e. the second reset temperature, is lower than 10° C. In such a case, the switch can only be reset by placing it in a refrigerator or by applying a cold spray.

According to a further refinement, the at least one switching mechanism comprises a temperature-independent spring part which is connected to the movable contact member, wherein the first snap-action part acts on the spring part when exceeding the first switching temperature and thereby lifts off the movable contact member from the first contact.

Apart from the additional temperature-dependent second snap-action part, the temperature-dependent switching mechanism can thus be designed in the conventional way with a temperature-dependent (first) snap-action part and a temperature-independent spring part.

The second snap-action part may in its high-temperature configuration be configured to exert an opening force on the movable contact member, which opening force keeps the contact member spaced apart from the first contact, and that the first snap-action part, in its low-temperature configuration, together with the spring part, exerts a closing force on the movable contact member, which closing force is oppositely arranged to the opening force and smaller in magnitude than the opening force.

This has the advantage that the self-holding function of the switch is guaranteed in a mechanically simple way. If the switch cools down to a temperature between the first and the second reset temperature after having opened once, i.e. after the first and second switching temperature have been exceeded, the movable contact member is still kept spaced apart from the first stationary contact by the second snap-action part. In this case, the second snap-action part exerts a spring force (here called "opening force") on the movable contact member which is greater than the closing force exerted by the first snap-action part and the spring part on the movable contact member together.

This can be achieved, for example, by making the spring constant of the second snap-action part larger than the sum of the spring constants of the first snap-action part and the spring part. This can be achieved by a correspondent shape of the second snap-action part, for example by making it slightly thicker than the first snap-action part and the spring part.

According to a further refinement, the spring part is a bistable spring part having two temperature-independent, stable geometric configurations.

Such a bistable design of the spring part has the advantage that the self-holding of the switch is further improved by this, since an inadvertent switching of the spring part from its one temperature-independent stable configuration to its other temperature-independent stable configuration is prevented.

Furthermore, the first and/or second snap-action part may comprise a bi- or trimetal snap-action disc.

According to a further refinement, the movable contact member comprises a first component and a second component connected thereto by means of a non-positive, firmly bonded or positive connection, wherein the first snap-action part engages on the first component and the second snap-action part engages on the second component.

In this refinement, the movable contact member is constructed in two parts. The two individual components of the movable contact member can be arranged one above the other. The first component can be used as the first contact mechanism on which the first snap-action part is arranged. The second component can be used as a second contact mechanism on which the second snap-action part is arranged. The two components of the movable contact member can be welded, soldered or crimped together.

The first snap-action part can be held captive on the first component or first contact mechanism of the movable contact member. The second snap-action part can be held captive on the second component or second contact mechanism. This has the advantage that the entire switching mechanism including the first and second snap-action part can be prefabricated and inserted into the switch as a complete pre-assembled unit.

If the switching mechanism also comprises a spring part, this can also be captive on the first component or the first contact mechanism of the moving part.

In a further refinement of the switch, it is preferred that the switch comprises a housing on which the first and the second stationary contacts are provided and in which the at least one switching mechanism is arranged.

This measure is known per se, it ensures that the switching mechanism is protected against the entry of dirt. The housing can be an individual housing of the switch or a pocket on the device to be protected from overheating.

Furthermore, it is preferred if the housing comprises a lower part closed by an upper part, wherein the first stationary contact or each of the two stationary contacts is arranged on an inner side of the upper part.

This measure is also known per se in terms of its design. In the case of the herein presented switch, it ensures that when the upper part is mounted on the lower part, the geometrically correct assignment between the first stationary contact or both stationary contacts and the movable contact member is simultaneously produced.

According to a further refinement of the switch, the first snap-action part is fixed to the movable contact member, but is apart from that in its geometrical low-temperature configuration freely suspended inside the housing without being supported by the housing or any other part of the switch. However, the second snap-action part may be arranged in the housing of the switch in such a way that it can be supported in its geometrical low-temperature configuration on a part of the housing.

If the first snap-action part switches back from its geometrical high-temperature configuration to its geometrical low-temperature configuration after the switch has been opened and has subsequently cooled down to a temperature below the first reset temperature, the first snap-action part cannot rest on the housing or any other part of the switch and thus cannot exert a closing force on the movable contact member. Unless the switch has cooled to a temperature below the second reset temperature at that time, the second snap-action part is still in its high-temperature configuration, holding the switch in its open position.

Due to the above-mentioned measure, the first snap-action part in this case does not counteract the second snap-action part despite its already achieved low-temperature configuration. This not only improves the self-holding function, but also extends the service life of the two snap-action parts, since they do not unnecessarily counteract each other.

In a further refinement, a disc-shaped, plate-shaped or annular support element is arranged locally between the first and the second snap-action part, which support element comprises a hole through which the movable contact member projects and on which the second snap-action part is at least in its geometrical high-temperature configuration supported.

This support element does not only serve to support the second snap-action part in its geometrical high-temperature configuration, in which the second snap-action part holds the switch in its open position and disconnects the electric circuit. The support element also serves for a spatial partition inside the switch housing, so that the two snap-action parts are separated from each other.

This has the advantage that the two snap-action parts do not act directly on each other and do not unintentionally influence each other when one or both snap-action parts snap over. The support element thus also prevents damage to the two snap-action parts, which damages could otherwise occur if they are in direct contact or act directly on each other.

According to a further refinement, the first snap-action part is arranged locally between the upper part and the support element and the second snap-action part is arranged locally between the support element and the lower part.

According to this refinement, the first snap-action part is thus arranged in the upper housing area and the second snap-action part in the lower housing area of the switch, wherein the two housing areas are separated from each other by the support element. Only the movable contact member, on which the two snap-action parts act, projects through the hole in the support element from the upper housing part into the lower housing part.

According to a further refinement of the switch, the movable contact member includes a movable contact part that interacts with the first stationary contact, and that the spring disc interacts with the second stationary contact. The spring member may comprise a bistable spring disc which, at least in its first configuration, is electrically connected to the second stationary contact via its edge.

A similar principle is disclosed in DE 10 2007 042 188 B3. It causes the load current of the electrical device to be protected to flow through the spring disc when the switch is closed. At least the first snap-action part is therefore not current-loaded in any position of the switch, which has a positive effect on its service life and switching behavior.

According to an alternative refinement, the movable contact member includes a current transfer member that interacts with both stationary contacts.

This has the advantage that the switch can carry considerably higher currents than the switch disclosed in DE 10 2007 042 188 B3. In this case, the movable contact member ensures an electrical short circuit between the two stationary contacts when the switch is closed, so that the load current of the electrical device to be protected no longer flows through either the two snap-action parts or the spring part. A similar configuration is disclosed in DE 10 2013 101 392 A1.

It goes without saying that the features referred to above and yet to be explained below can be used not only in the respective given combinations, but also in other combinations or alone without leaving the spirt and scope of this disclosure.

DESCRIPTION OF PREFERRED EMBODIMENTS

Figure 1:
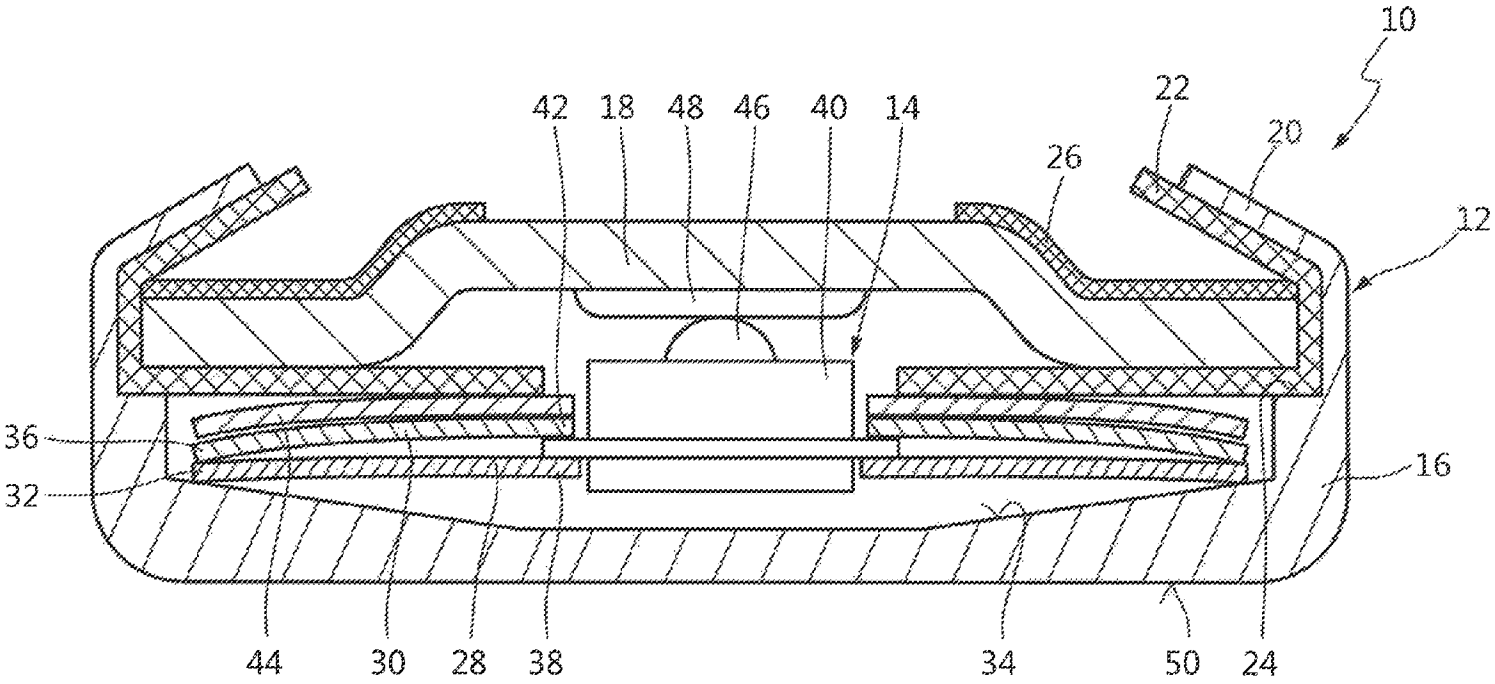
FIG. 1 shows a schematic sectional view of a first embodiment of the switch in a first switching position.

FIG. 1 shows a schematic, sectional view of a switch 10, which is rotationally symmetrical in top view and preferably has a circular shape.

The switch 10 comprises a housing 12, in which a temperature-dependent switching mechanism 14 is arranged. The housing 12 includes a pot-shaped lower part 16 and an upper part 18, which is held to the lower part 16 by a bent or flanged edge 20.

In the first embodiment shown in FIG. 1, both the lower part 16 and the upper part 18 are made of an electrically conductive material, preferably metal. The upper part 18 rests on a shoulder 24 inside the lower part 16, with an interposed insulating foil 22.

The insulating foil 22 provides an electrical insulation of the upper part 18 against the lower part 16. In addition, the insulating foil 22 also provides a mechanical seal that prevents liquids or contaminants from entering the interior of the housing from the outside.

Since the lower part 16 and the upper part 18 are in this embodiment each made of electrically conductive material, thermal contact to an electrical device to be protected can be produced via their outer surfaces. The outer surfaces are also used for the external electrical connection of the switch 10.

Another insulation layer 26 can be applied to the outside of the upper part 18, as shown in FIG. 1.

The switching mechanism 14 comprises a temperature-independent spring part 28, which is configured as a spring disc, and a temperature-dependent snap-action part 30, which is configured as a snap-action disc.

The spring part 28 is preferably configured as a bistable spring disc. Accordingly, the spring disc 28 has two temperature-independent stable geometric configurations. The first geometrical configuration is shown in FIG. 1.

The temperature-dependent snap-action part 30, which is herein referred to as the first snap-action part 30, is configured as a bistable snap-action disc, for example. The snap-action disc 30 has two temperature-dependent configurations, a geometrical high-temperature configuration and a geometrical low-temperature configuration. In the first switching position of the switching mechanism 14 shown in FIG. 1, the first snap-action disc 30 is in its low-temperature configuration.

The spring disc 28 rests with its edge 32 on an inner bottom surface 34 of the lower part 16. The inner bottom surface 34 is substantially concave in shape and is slightly raised at the point where the edge 32 of the spring disc 28 rests in the first switching position shown in FIG. 1 compared to the central area of the inner bottom surface 34. The edge 36 of the first snap-action disc 30 rests on the spring disc 28 in its low-temperature configuration shown in FIG. 1.

The spring disc 28 is with its center 38 fixed to a movable contact member 40 of the switching mechanism 14. The first snap-action disc 30 is with its center 42 also fixed to this contact member 40. In this way, the temperature-dependent switching mechanism 14 is a captive unit consisting of contact member 40, spring disc 28 and first snap-action disc 30. When mounting the switch 10, the switching mechanism 14 can thus be inserted as a unit directly into the lower part 16.

A second snap-action part 44 is arranged above the first snap-action disc 30 in the embodiment shown in FIG. 1. Similar to the first snap-action disc 30, this second snap-action disc 44 is preferably configured as a temperature-dependent, bistable snap-action disc. This second snap-action disc 44 also preferably has two configurations, a geometrical high-temperature configuration and a geometrical low-temperature configuration. In the first switching position of the switching mechanism 14 shown in FIG. 1, the second snap-action disc 44 is in its geometrical low-temperature configuration.

In the example shown in FIG. 1, the second snap-action disc 44 preferably rests on the first snap-action disc 30. The second snap-action disc 44 is not firmly connected to the first snap-action disc 30. In the first embodiment shown in FIG. 1, the second snap-action disc 44 is also not firmly connected to the movable contact member 40. In the low-temperature configuration shown in FIG. 1, it is only supported by the switching mechanism 14 or rests on it from above.

Since the second snap-action disc 44 has a decisive influence on the switching behavior of switch 10 just like the first snap-action disc 30, the second snap-action disc 44 can basically be regarded as part of the switching mechanism 14. However, depending on the definition, the second snap-action disc 44 can also be considered as a separate component.

On its upper side, the movable contact member 40 comprises a movable contact part 46. The movable contact part 46 interacts with a fixed counter contact 48, which is located on an inner side of the upper part 18. This counter contact 48 is herein also referred to as the first stationary contact. The outside of the lower part 16 of the switch 10 shown in FIG. 1 serves as the second stationary contact 50.

In the position shown in FIG. 1, the switch 10 is in its low-temperature position (first switching position), in which the spring disc 28 is in its first configuration and the two snap-action discs 30, 44 are in their respective low-temperature configuration. In the low-temperature position of the switch 10 according to FIG. 1, an electrically conductive connection between the first stationary contact 48 and the second stationary contact 50 is produced via the movable contact member 42 and the spring disc 30.

Figure 2:
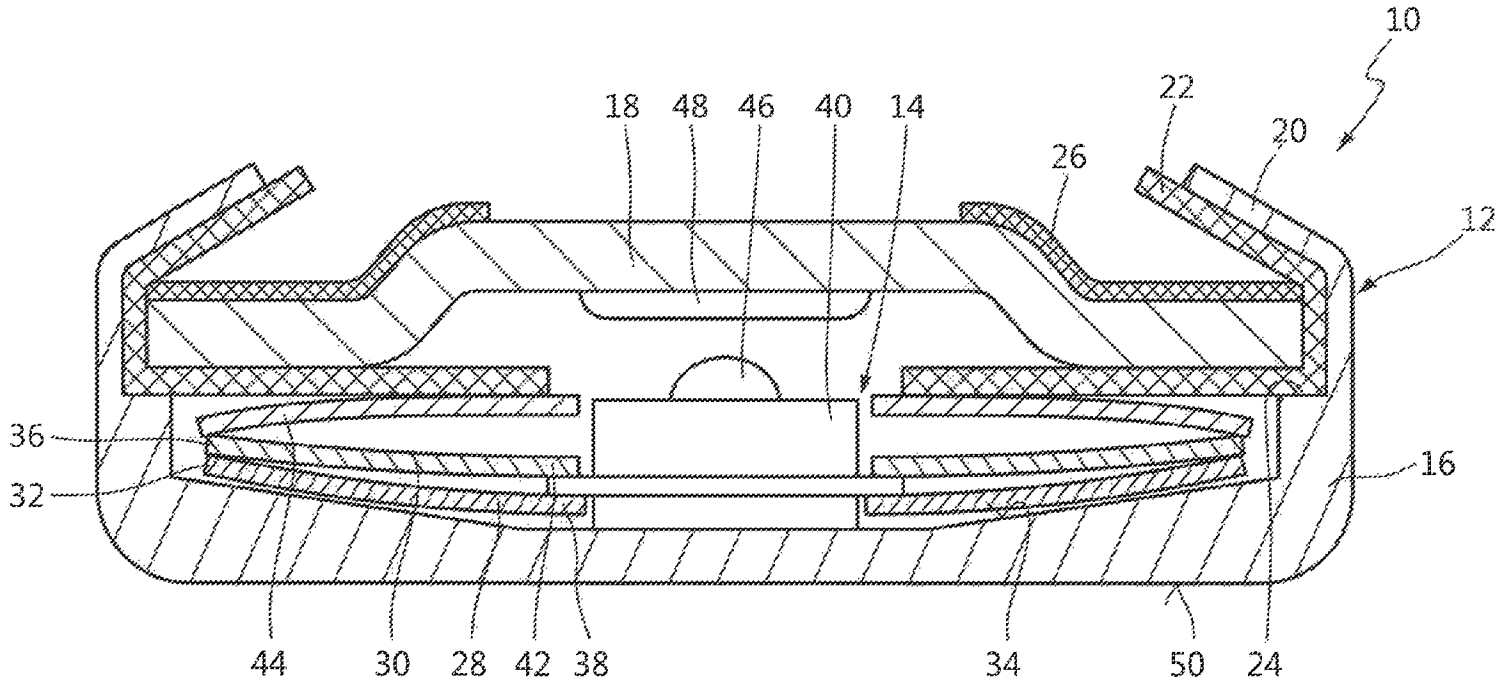
FIG. 2 shows a schematic sectional view of the first embodiment of the switch in a second switching position.

If the temperature of the device to be protected, and thus the temperature of the switch 10 and the first snap-action disc located therein, increases, the first snap-action disc switches from the low-temperature configuration shown in FIG. 1 to its concave high-temperature configuration shown in FIG. 2.

When switching, the first snap-action disc 30 is with its edge 36 supported by the second snap-action disc 44, wherein the second snap-action disc 44 is clamped between the first snap-action disc 30 and the upper part 18 or the insulating foil 22. With its center 42, the first snap-action disc 30 pulls the movable contact member 40 downwards and lifts off the movable contact member 46 from the first stationary contact 48. This simultaneously bends the spring disc 28 at its center 38 downward so that the spring disc 28 snaps from its first stable geometric configuration shown in FIG. 1 to its second stable geometric configuration shown in FIG. 2. The electric circuit is thus disconnected.

The switching operation, which moves the switch 10 from its closed position shown in FIG. 1 to its open position shown in FIG. 2, occurs upon reaching or exceeding the switching temperature of the first snap-action disc 30. This switching temperature is herein referred to as first switching temperature.

On the other hand, the second snap-action disc 44 is designed in such a way that its switching temperature, at which it switches from its geometrical low-temperature configuration to its geometrical high-temperature configuration, is slightly higher than the first switching temperature. The switching temperature of the second snap-action disc 44 is herein referred to as second switching temperature.

FIG. 2 thus shows the switch 10 in its second switching position, in which the first switching temperature has been reached or exceeded, but the second switching temperature has not yet been reached.

In the second switching position of the switch 10 shown in FIG. 2, the second snap-action disc 44 is therefore still in its geometrical low-temperature configuration as it is also shown in FIG. 1. However, since the second snap-action disc 44 is not firmly connected to the movable contact member 40, the second snap-action disc 44 in this position does not exert any force on the movable contact member 40 which would counteract the force exerted by the spring disc 28 and the first snap-action disc 30 on the movable contact member 40. Upon reaching the first switching temperature, the switch 10 is thus in any case open.

Figure 3:
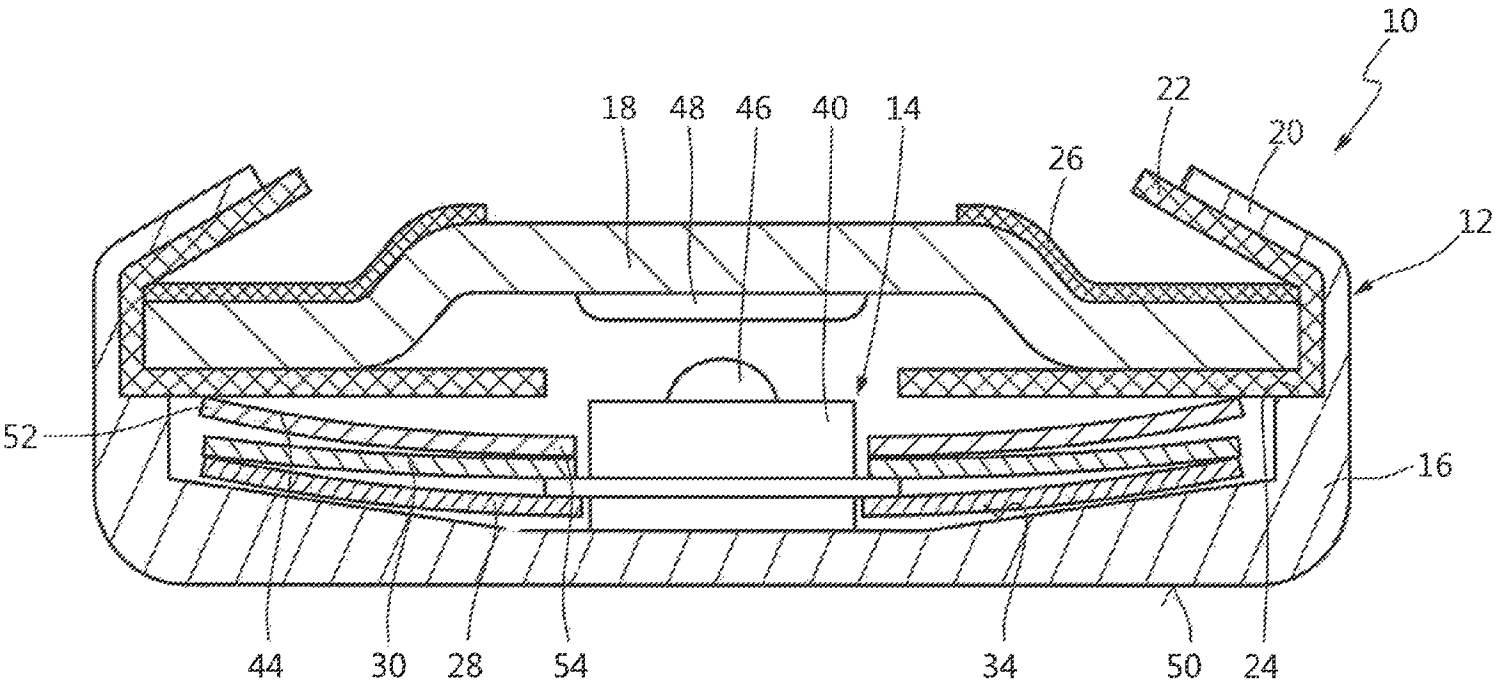
FIG. 3 shows a schematic sectional view of the first embodiment of the switch in a third switching position.

If the temperature of the switch 10 and thus also the temperature of the second snap-action disc 44 increases further beyond the second switching temperature after reaching the switching position shown in FIG. 2, the second snap-action disc 44 also switches from its convex low-temperature position shown in FIG. 2 to the concave high-temperature position shown in FIG. 3. It then rests with its edge 52 on the upper part 18 or on the insulating foil 22 arranged below it and presses with its center 54 on the first snap-action disc 30. As a result, the second snap-action disc 44 also exerts a force on the movable contact member 40 which keeps the movable contact member 46 spaced apart from the first stationary contact 48.

Such a further increase in temperature despite the switch 10 already being open is quite common in practice due to the residual heat of the electrical device to be protected. This is typically referred to as the overshoot temperature or the overshoot temperature range of the switch 10.

The switching temperature of the second snap-action disc 44 is preferably located at this overshoot temperature or in this overshoot temperature range and thus preferably only slightly higher than the first switching temperature of the first snap-action disc 30.

However, it is also generally possible to design the second snap-action disc 44 in such a way that it switches from its geometrical low-temperature configuration to its geometrical high-temperature configuration concurrently with the first snap-action disc 30. In this case, the second switching temperature would thus correspond to the first switching temperature. The function of the switch 10 would remain basically the same, since it would also be opened then upon reaching the first switching temperature. In this case, however, it would go directly from the first switching position shown in FIG. 1 to the third switching position shown in FIG. 3, in which both snap-action discs 30, 44 have snapped over to their high-temperature configuration.

In principle, it would even be possible that the second switching temperature is lower than the first switching temperature, so that upon heating the switch 10 the second snap-action disc 44 switches to its high-temperature configuration and opens the switch before the first snap-action disc. However, this would require that the force exerted by the second snap-action disc 44 in its high-temperature configuration on the movable contact member 40 is greater than the force exerted by the first snap-action disc 30 in its low-temperature configuration and the spring disc 28 in its first configuration on the movable contact member 40 together.

However, it is generally preferred that the first snap-action disc 30 is responsible for opening the switch 10, i.e. that the first switching temperature is lower than the second switching temperature or at least equal to the second switching temperature.

Figure 4:
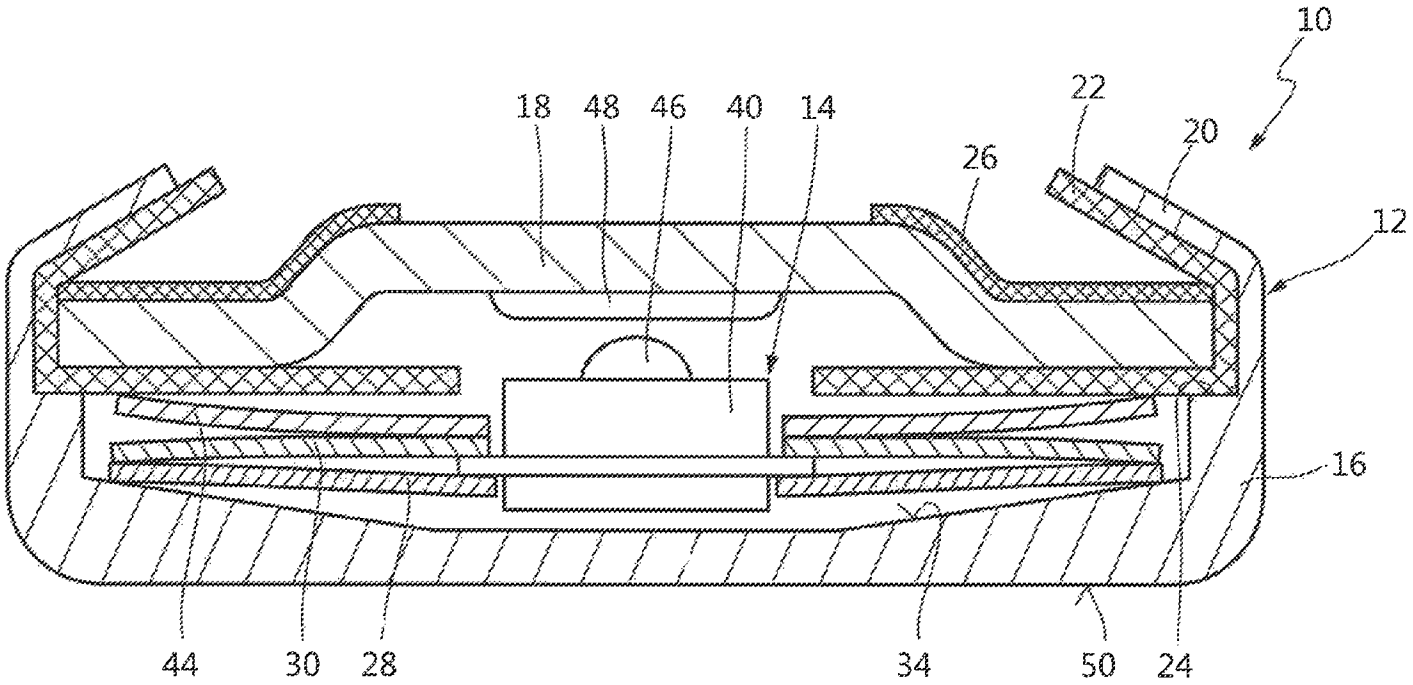
FIG. 4 shows a schematic sectional view of the first embodiment of the switch in a fourth switching position.

Since the electric circuit of the electrical device to be protected is disconnected, the switch 10 now cools down again. As soon as the switch 10 has cooled down to or below the reset temperature of the first snap-action disc 30 (first reset temperature), the snap-action disc 30 switches from its high-temperature position shown in FIG. 3 back to its low-temperature position and thereby pulls the spring disc 28 upwards again in the direction of its first configuration. Since the reset temperature of the second snap-action disc 44 (second reset temperature) is lower than the first reset temperature, the second snap-action disc 44 will still remain in its high-temperature configuration upon reaching the first reset temperature. This results in the fourth switching position shown in FIG. 4, in which the movable contact part 46 remains spaced apart from the first stationary contact 48 and the switch 10 is thus still open.

In this case, the second snap-action disc 44 exerts a greater spring force on the movable contact member 40 than the first snap-action disc 30 and the spring disk 28 together, which actually try to move the movable contact member 46 towards the first stationary contact 48. According to this first embodiment of the switch 10, the second snap-action disc 44 has a higher spring constant than the first snap-action disc 30 and the spring disc 28 together.

In this way, the second snap-action disc 44 provides the self-holding function, which keeps the switch 10 open even after the temperature has fallen below the first reset temperature. This self-holding function is only deactivated when the switch 10 also cools down to or below the second reset temperature. Only then does the second snap-action disc 44 switch from its high-temperature configuration back to its low-temperature configuration so that the switch 10 is closed and the first switching position shown in FIG. 1 is obtained.

The second snap-action disc 44 is preferably designed in such a way that its second reset temperature is below room temperature. The switch 10 can therefore only be reset after it has been opened by means of external cold treatment, for example with a cold spray.

Figure 5:
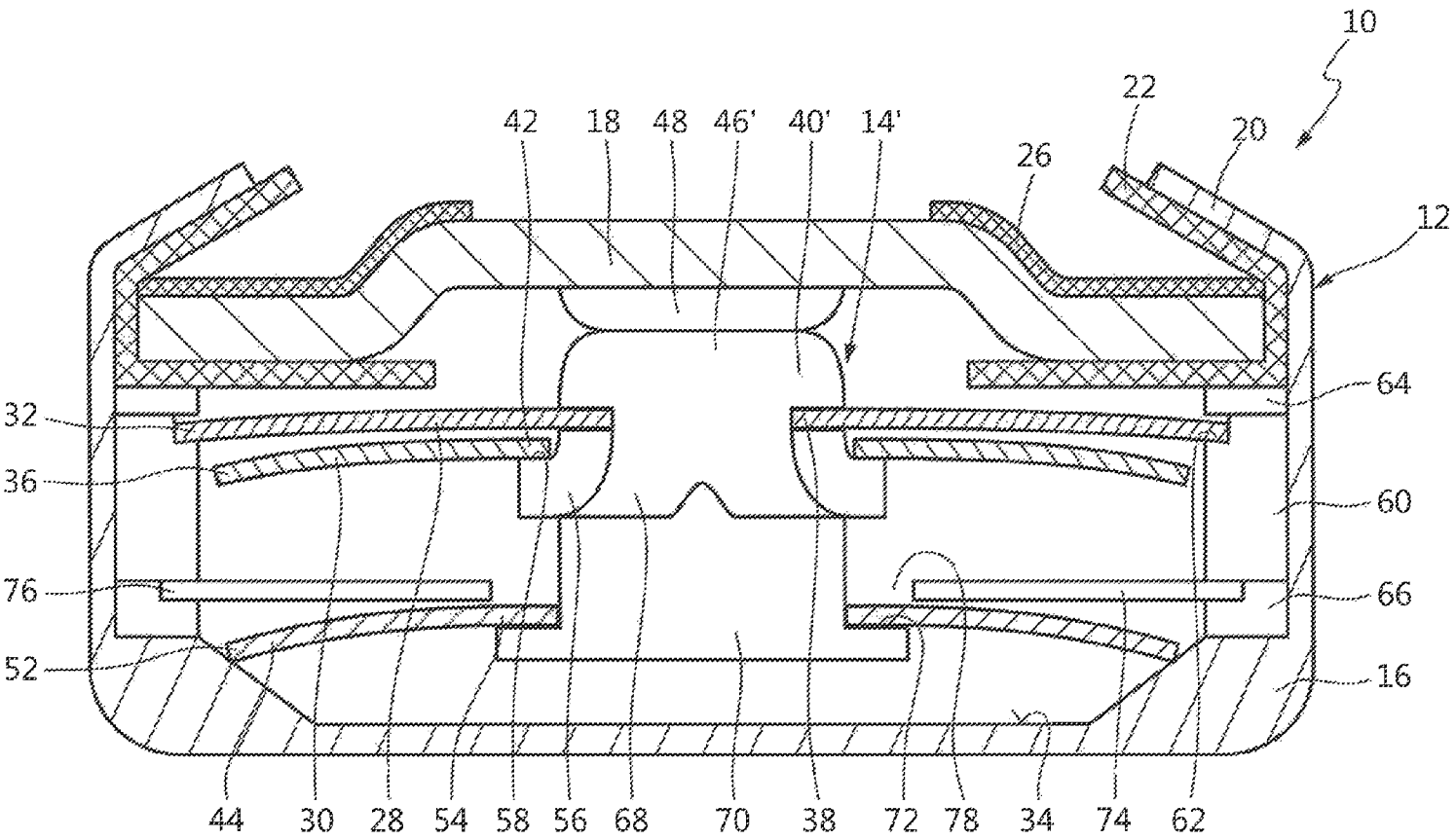
FIG. 5 shows a schematic sectional view of a second embodiment of the switch in a first switching position.

The switch 10 as shown in the second example in FIG. 5 is generally based on the same functional principle as the switch 10 according to the first embodiment shown in FIGS. 1-4. In addition to a spring part 28 which is configured as a temperature-independent spring disc, this switch 10 also comprises a first snap-action part 30, which is a temperature-dependent snap-action disc, and a second snap-action part 44, which is also a temperature-dependent snap-action disc. Also in this case, the second snap-action disc 44 causes the self-holding function of the switch 10, which is especially caused by the fact that the (second) reset temperature of the second snap-action disc 44 is lower than the (first) reset temperature of the first snap-action disc 30.

However, the construction of the switching mechanism 14' according to the second embodiment of the switch 10 shown in FIG. 5 is slightly different from the first embodiment.

The movable contact part 46' of the movable contact member 40' has a slightly different shape here. In addition, the movable contact member 40' comprises a ring 56 which surrounds the contact member 40'. This ring 56 is preferably pressed onto the movable contact part 46'.

The ring 56 comprises a circumferential shoulder 58 on which the first snap-action disc 30 rests with its center 42. In the low-temperature configuration of the first snap-action disc 30 shown in FIG. 5, the edge 36 of the first snap-action disc 30 is according to this embodiment not supported by the housing 12. The edge 36 of the first snap-action disc 30 is freely suspended in the low-temperature configuration. In the closed state of the switch 10 shown in FIG. 5, the first snap-action disc 30 therefore exerts no force on the movable contact member 40'.

In the closed state of the switch 10, the contact pressure between the movable contact part 46' of the movable contact member 40' and the first stationary contact 48 is at least partially caused by the spring disc 28. The spring disc 28 is clamped with its center 38 between the ring 56 and the widened upper section of the contact member 40'.

The spring disc 28 rests with its edge 32 on a spacer element 60. This spacer element 60 is preferably configured as a spacer ring which is inserted into the lower part 16 of the housing 12. A circumferential shoulder 62 is provided on this spacer element 60, which circumferential shoulder serves as support for the edge 32 of the spring disc 28.

The spacer element 60 is clamped between two further spacer rings 64, 66. The spacer ring 64 is arranged above the edge 32 of the spring disc 28 and clamped between the spacer ring 60 and the upper part 18 with the insulating foil 22 interposed. The spacer ring 66 is arranged below the spacer ring 60 and clamped between the latter and the lower part 16 of the housing 12.

In the embodiment shown in FIG. 5, the movable contact member 40' comprises two separate components in addition to the ring 56, a first component 68, which carries or forms the movable contact member 46', and a second component 70. The second component 70 is arranged on a lower side of the first component 68 facing away from the first stationary contact 48. The two components 68, 70 of the movable contact member 40' are preferably connected to each other by means of a non-positive, firmly bonded or positive connection. For example, these two components 68, 70 can be welded, soldered or crimped together. In principle, however, it would also be possible to provide the two components 68, 70 of the movable contact member 40' as one piece or integrally connected to each other.

The second snap-action disc 44 engages the second component 70 of the movable contact member 40'. Its center 54 rests on a circumferential shoulder 72 formed on the second component 70 and is attached or fixed to the movable contact member 40' at this point.

In the closed position of the switch 10 shown in FIG. 5, in which the second snap-action disc 30 is in its low-temperature configuration, the edge 52 of the second snap-action disc 44 rests on the inner bottom surface 34 of the lower part 16. In the closed position of the switch 10, the second snap-action disc 44 thus provides the contact pressure between the movable contact part 46' and the first stationary contact 48 in addition to the spring disc 28.

Furthermore, a disc-shaped, plate-shaped or annular support element 74 is arranged in the housing 12, more precisely in the lower part 16. This support element 74 projects laterally from the outside into the interior of the housing 12. At its edge 76 it is clamped between the distance ring 66 and the distance ring 60. In its center the support element 74 comprises a hole 78 through which the movable contact member 40' projects.

The support element 74 divides the interior of the housing 12 into two areas, an upper area, in which the spring disc 28 and the first snap-action disc 30 are arranged, and a lower area, in which the second snap-action disc 44 is arranged. In other words, the spring disc 28 and the first snap-action disc 30 are arranged between the upper part 18 and the support element 74, whereas the second snap-action disc 44 is arranged between the support element 74 and the lower part 16.

The general function of the second embodiment of the switch 10 shown in FIGS. 5-8 is generally similar to the function of the switch shown in FIGS. 1-4.

The first snap-action disc 30 is substantially used to open the switch 10, i.e. to move it from its first closed position to its second open position. The second snap-action disc 44 substantially provides the self-holding function which keeps the switch 10 open even if the first snap-action disc 30 switches from its high-temperature configuration back to its low-temperature configuration after the switch 10 has been opened. Therefore, it is also provided in this embodiment of the switch 10 that the (second) switching temperature of the second snap-action disc 44 is equal to or higher than the (first) switching temperature of the first snap-action disc 30. It is also provided that the (second) reset temperature of the second snap-action disc 44 is lower than the (first) reset temperature of the first snap-action disc 30.

Figure 6:
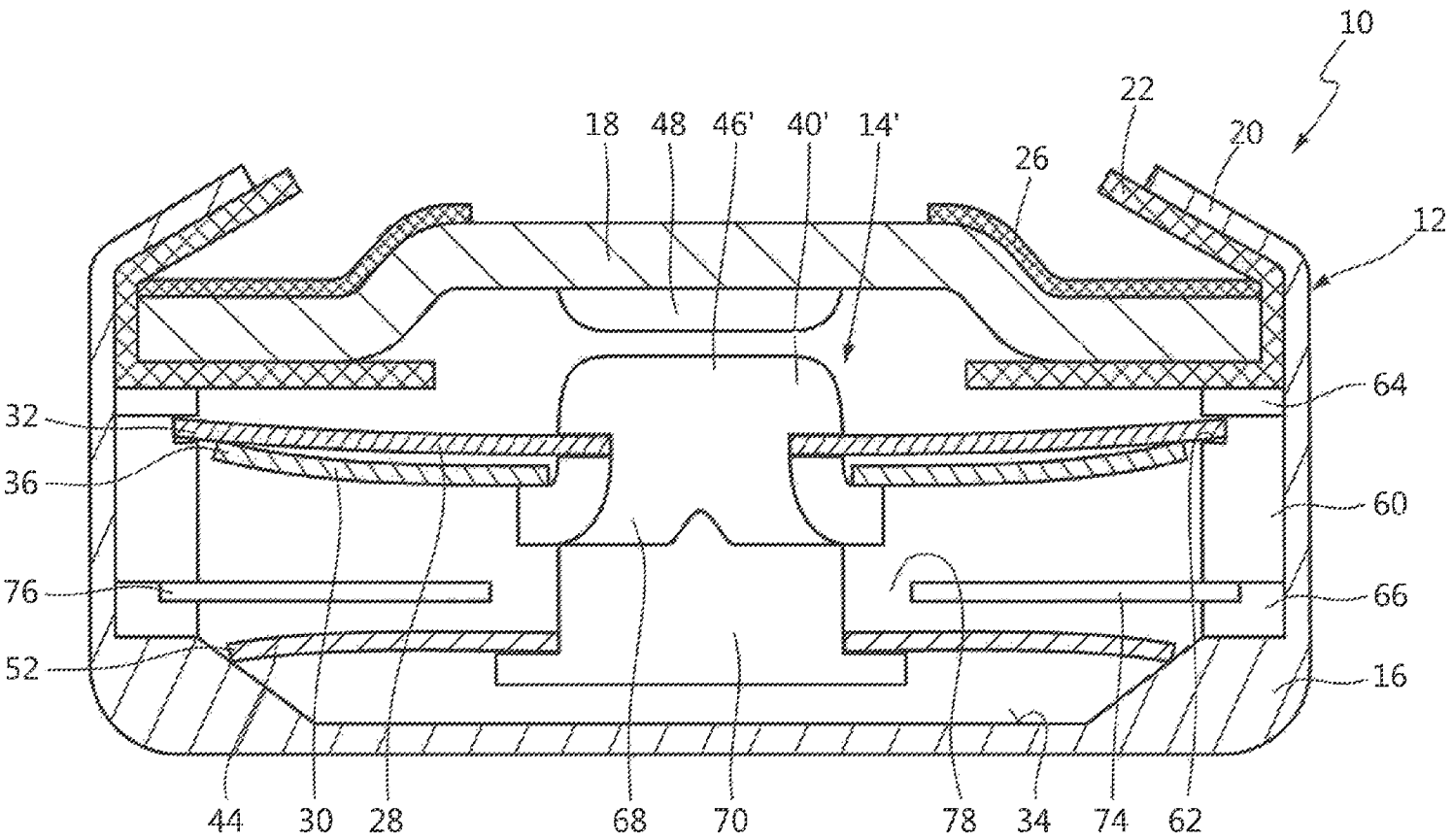
FIG. 6 shows a schematic sectional view of the second embodiment of the switch in a second switching position.

When the switch 10 and thus the first snap-action disc 30 heats up to a temperature above the first switching temperature, the first snap-action disc 30 switches from its low-temperature configuration shown in FIG. 5 to its high-temperature configuration shown in FIG. 6. The first snap-action disc 30 is thereby supported with its edge 36 by the lower side of the spring disc 28 and thus moves the spring disc 30 from its first geometric configuration shown in FIG. 5 to its second geometric configuration shown in FIG. 6.

In contrast to the first embodiment, the spring disc 28 and the first snap-action disc 30 thereby exert a spring force on the movable contact member 40', which spring force is greater than the spring force exerted by the second snap-action disc 44 on the movable contact member 40' and acting in the opposite direction. If the second switching temperature is higher than the first switching temperature and the second switching temperature has not yet been reached, the second snap-action disc remains in its low-temperature configuration as shown in FIG. 6, in which it presses the movable contact member 40' in the direction of the first stationary contact 48. However, due to the specified force conditions, the movable contact member 46' is still lifted off the first stationary contact 48 upon reaching the first switching temperature (see FIG. 6).

In this embodiment of the switch 10, the spring disc 28 and the first snap-action disc 30 do not necessarily have to be designed in such a way that their spring force exerted together on the movable contact member 40' is greater than the spring force exerted by the second snap-action disc 44 on the movable contact member 40'. If this is not the case, however, the (second) switching temperature of the second snap-action disc 44 shall be the same or even lower than the (first) switching temperature of the first snap-action disc 30. In this case, upon reaching the first switching temperature, the switching position of the switch 10 shown in FIG. 6 would not be reached but directly the switching position of the switch 10 shown in FIG. 7, in which both snap-action discs 30, 44 are in their high-temperature configuration.

Figure 7:
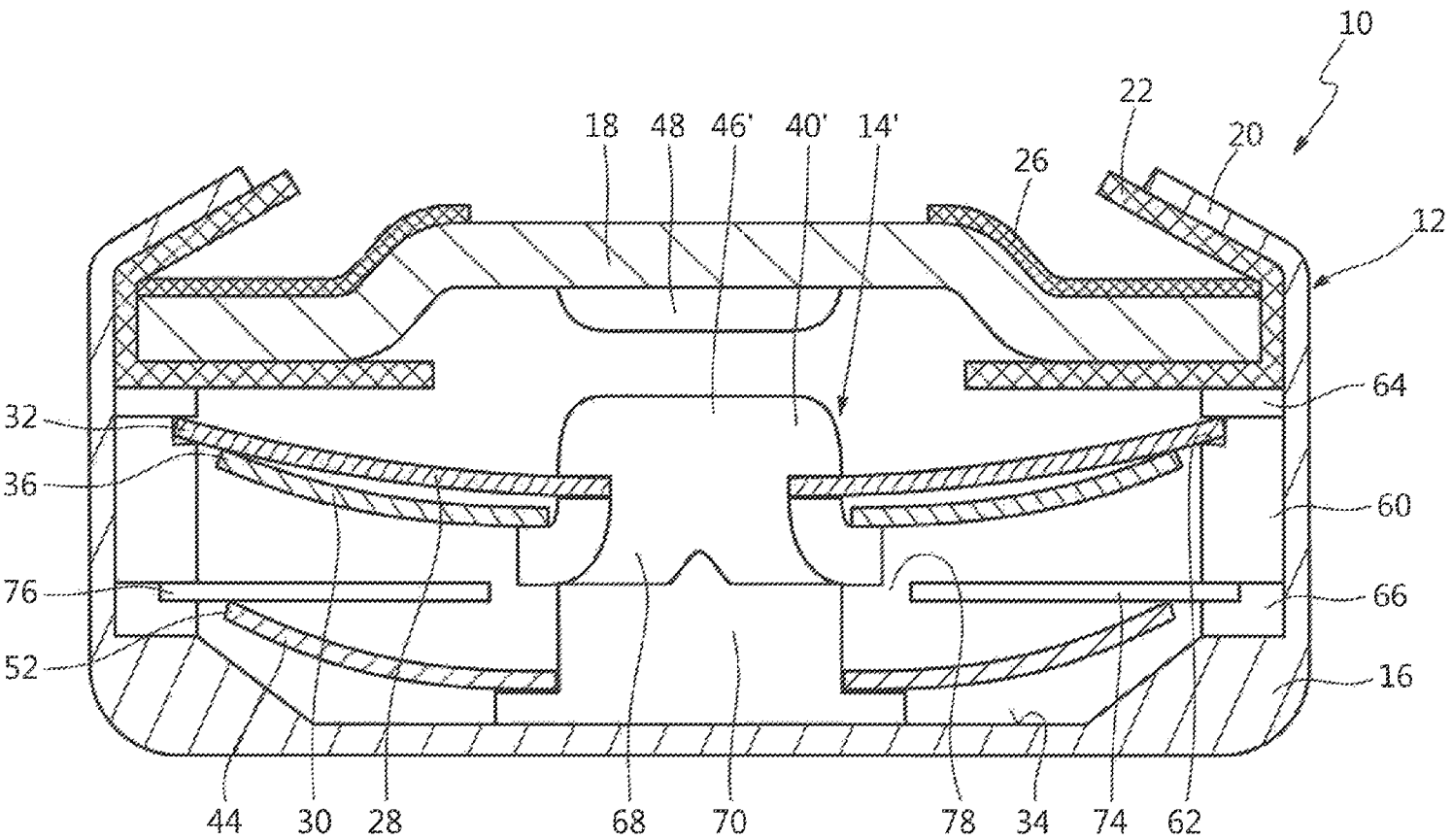
FIG. 7 shows a schematic sectional view of the second embodiment of the switch in a third switching position.

In the first case described above, in which the first switching temperature is lower than the second switching temperature and the spring disc 28 together with the first snap-action disc 30 generates a greater force than the second snap-action disc 44, the switch 10 would first be moved to the switching position shown in FIG. 6 upon reaching the first switching temperature and would only be moved to the switching position shown in FIG. 7 upon reaching the second switching temperature.

Nevertheless, in both cases, the switch 10 is opened and the electric circuit is disconnected already upon reaching the first switching temperature.

In the switching position of the switch 10 shown in FIG. 7, the second snap-action disc 44 is in its high-temperature configuration. Its edge 52 is supported by the support element 74 and its center 54 pushes the movable contact member 40' downwards.

Figure 8:
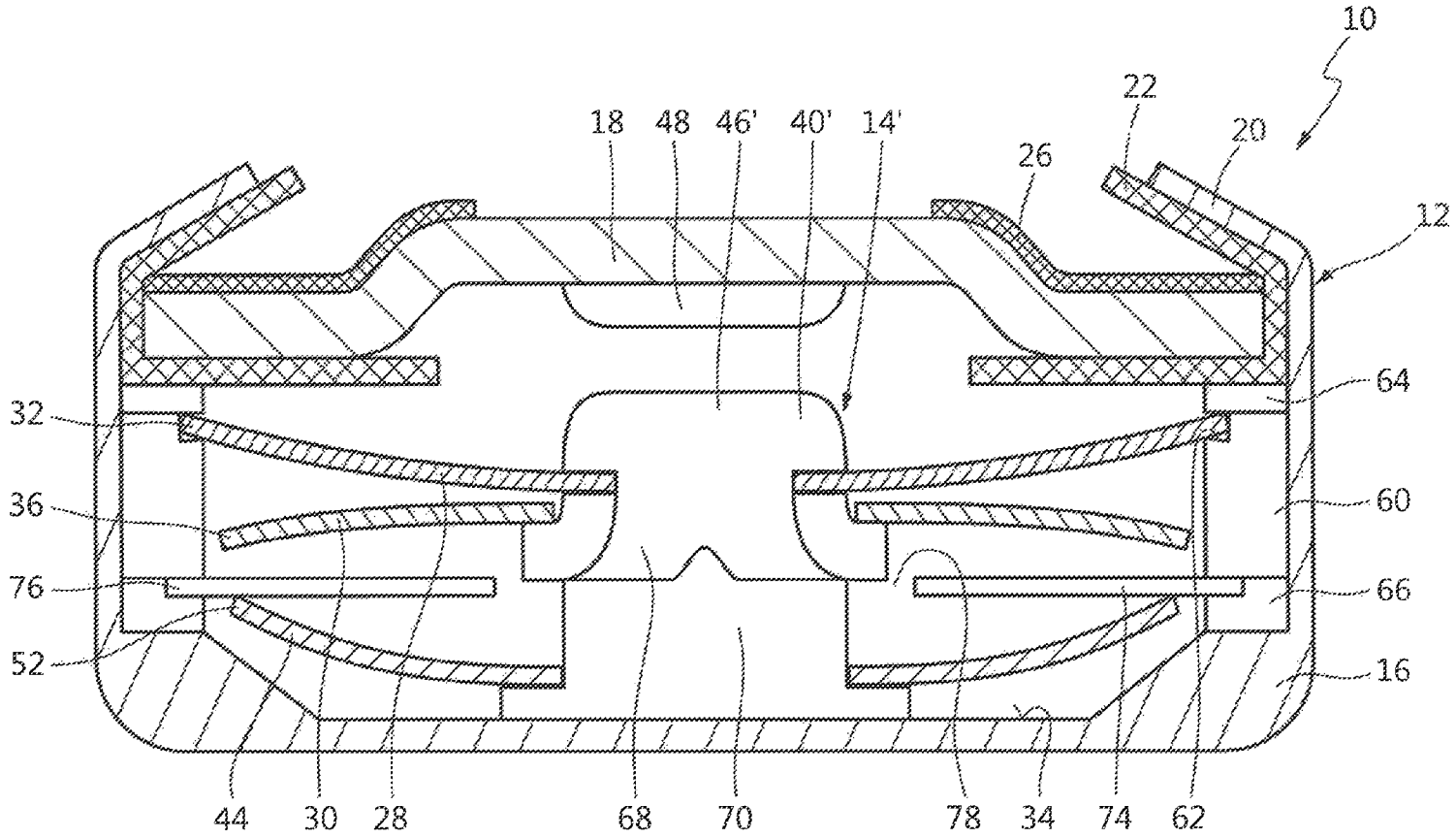
FIG. 8 shows a schematic sectional view of the second embodiment of the switch in a fourth switching position.

If the switch 10 then cools down again in the further course, the first snap-action disc 30 switches from its high-temperature configuration shown in FIG. 7 back to its low-temperature configuration shown in FIG. 8 upon reaching the first reset temperature. However, since the edge 36 of the first snap-action disc 30 in its low-temperature configuration cannot be supported by a part of the switch but is freely suspended in the housing 12, the first snap-action disc 30 does not exert any force on the movable contact member 40' to move the movable contact member 46' in the direction of the first stationary contact 48.

Since the second snap-action disc 44, upon reaching the first reset temperature, remains in its high-temperature configuration as shown in FIG. 8, it presses down the movable contact member 40' together with the spring disc 28, which remains in its second geometric configuration, so that the movable contact member 46' remains spaced apart from the first stationary contact 48.

Figure 9:
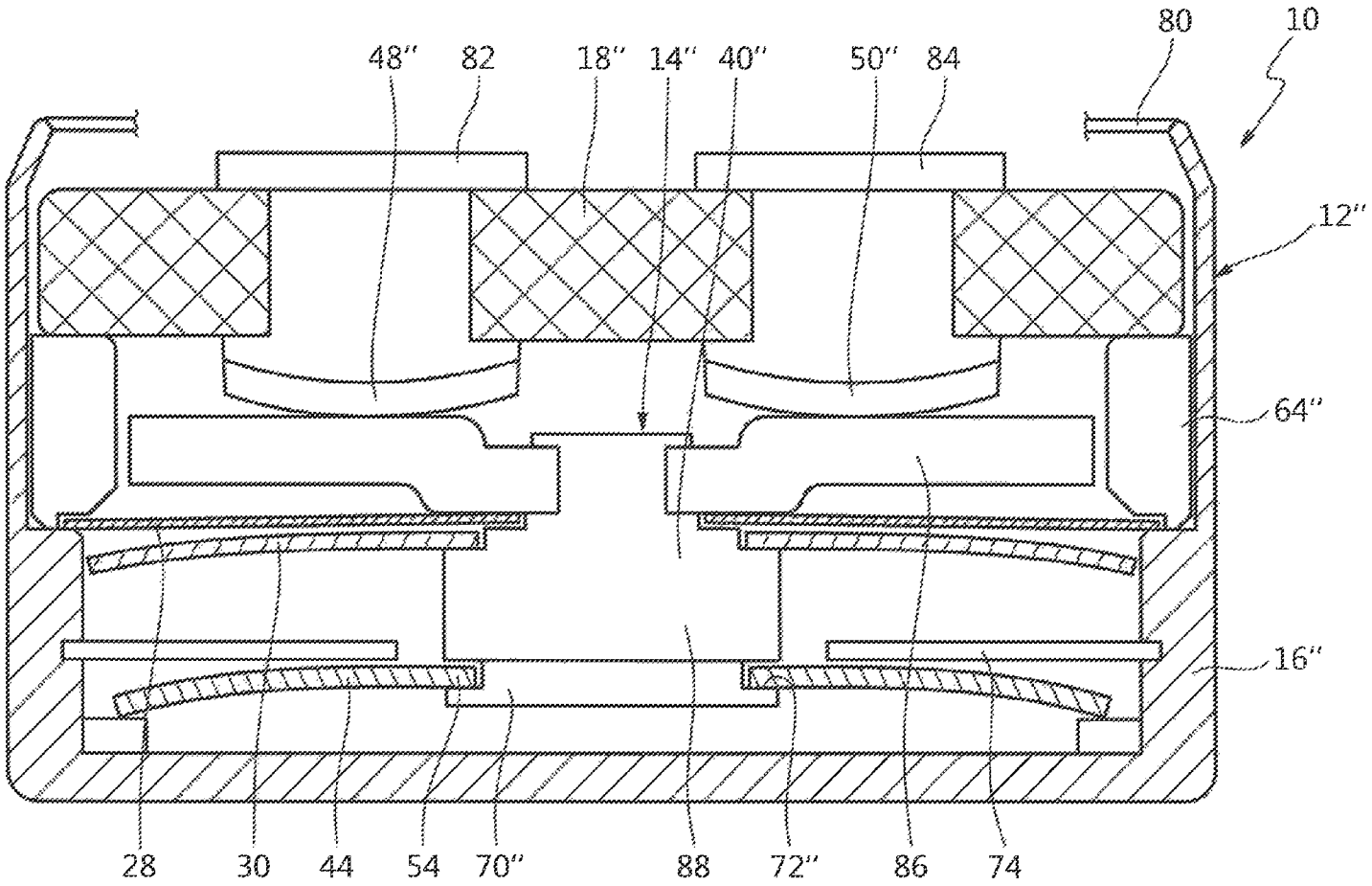
FIG. 9 shows a schematic sectional view of a third embodiment of the switch in a first switching position.

FIG. 9 shows a third embodiment of the switch 10 in its closed position (first switching position). Since the interaction of the spring disc 28, the first snap-action disc 30 and the second snap-action disc 44 is based on a substantially identical or at least very similar functional principle as described with respect to the second embodiment shown in FIGS. 5-8, the other switching positions of the switch 10 according to this third embodiment are not shown again here.

The switch 10 according to the third embodiment shown in FIG. 9 differs from the previous embodiments mainly in the construction of the housing 12". The lower part 16" is again made of electrically conductive material. The flat upper part 18" is made of electrically insulating material. It is held on the lower part 16" by a bent edge 80.

Between the upper part 18" and the lower part 16" a spacer ring 64" is also provided here, which keeps the upper part 18" spaced apart from the lower part 16". On its inside, the upper part 18" has a first stationary contact 48" and a second stationary contact 50". The stationary contacts 48" and 50" are designed as rivets which extend through the upper part 18" and end on the outside in the heads 82, 84, which serve for the external connection of the switch 10.

The switching mechanism 14" is also designed differently than before. The movable contact member 40" comprises a current transfer member 86, which in the embodiment shown in FIG. 9 is a contact plate whose upper side is coated with an electrically conductive coating so that it provides an electrically conductive connection between the two contacts 48" and 50" when the contact is made at the contacts 48" and 50" as shown in FIG. 9.

The current transfer member 86 is connected to the spring disc 28 and the first snap-action disc 30 via a rivet 88, which is also to be regarded as part of the contact member 40". Similarly as before, a second component 70" is arranged on the lower side of this rivet 88, which second component comprises a circumferential shoulder 72" on which the second snap-action disc 44 rests with its center 54.

The main advantage of the switch design shown in FIG. 9 is that, in contrast to the first two embodiments of the switch 10 shown in FIGS. 1-8, no current flows through either the spring disc 28 or the two snap-action discs 30, 44 when the switch 10 is closed. This current only flows from the first external terminal 82 via the first stationary contact 48", the current transfer member 86 and the second stationary contact 50" to the second external terminal 84.

It goes without saying that the other construction of the switching mechanism 14", i.e. in particular the arrangement of the spring disc 28 and the two snap-action discs 30, 44, does not necessarily have to correspond to the arrangement shown in FIG. 9. Therefore, the arrangement of the spring disc 28 and the two snap-action discs 30, 44 do not necessarily have to be identical or similar to the arrangement described in the second embodiment shown in FIG. 5-8, but may also correspond to the arrangement described in the first embodiment shown in FIG. 1-4.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A temperature-dependent switch that comprises a first stationary contact, a second stationary contact, and a temperature-dependent switching mechanism having a movable contact member, wherein the switching mechanism, in a first switching position, presses the movable contact member against the first stationary contact and thereby produces an electrically conductive connection between the first stationary contact and the second stationary contact via the movable contact member and, in a second switching position, keeps the movable contact member spaced apart from the first stationary contact, wherein the switching mechanism comprises a first temperature-dependent snap-action part which is configured to switch from a first geometric low-temperature configuration to a first geometric high-temperature configuration when exceeding a first switching temperature, and to switch from the first geometric high-temperature configuration back to the first geometric low-temperature configuration when subsequently falling below a first reset temperature, wherein the switch further comprises a second temperature-dependent snap-action part which is configured to switch from a second geometric low-temperature configuration to a second geometric high-temperature configuration when exceeding a second switching temperature that is equal to or higher than the first switching temperature, and to switch from the second geometric high-temperature configuration back to the second geometric low-temperature configuration when subsequently falling below a second reset temperature, wherein switching the first temperature-dependent snap-action part from the first geometric low-temperature configuration to the first geometric high-temperature configuration and/or switching the second temperature-dependent snap-action part from the second geometric low-temperature configuration to the second geometric high-temperature configuration brings the switching mechanism from the first switching position to the second switching position, wherein the second reset temperature is lower than the first reset temperature, wherein the second temperature-dependent snap-action part is configured to keep the movable contact member spaced apart from the first stationary contact even if the switch has heated above the first switching temperature and the second switching temperature and has subsequently cooled down to a temperature between the first reset temperature and the second reset temperature, and wherein the second temperature-dependent snap-action part is configured to bring the switching mechanism from the second switching position back to the first switching position when the switch has heated above the first switching temperature and the second switching temperature and has subsequently cooled down to a temperature equal to or lower than the second reset temperature.

2. The switch according to claim 1, wherein the second reset temperature is lower than room temperature.

3. The switch according to claim 1, wherein the second reset temperature is lower than 15° C.

4. The switch according to claim 1, wherein the switching mechanism comprises a temperature-independent spring part that is connected to the movable contact member, wherein the first temperature-dependent snap-action part is configured to act on the spring part when exceeding the first switching temperature and to thereby lift off the movable contact member from the first stationary contact.

5. The switch according to claim 4, wherein the second snap-action part is in the second geometric high-temperature configuration configured to exert an opening force on the movable contact member so as to keep the movable contact member spaced apart from the first stationary contact, and wherein the first snap-action part is in the first geometric low-temperature configuration configured to exert a closing force together with the spring part on the movable contact member, wherein the closing force is oppositely arranged to the opening force and smaller in magnitude than the opening force.

6. The switch according to claim 4, wherein the spring part comprises a bistable spring part having two temperature-independent, stable geometric configurations.

7. The switch according to claim 1, wherein the first temperature-dependent snap-action part comprises a first bimetal or trimetal snap-action disc.

8. The switch according to claim 1, wherein the second snap-action part comprises a second temperature-dependent bimetal or trimetal snap-action disc.

9. The switch according to claim 1, wherein the movable contact member comprises a first component and a second component that is connected to the first component by means of a non-positive, firmly bonded or positive connection, wherein the first temperature-dependent snap-action part contacts the first component and the second temperature-dependent snap-action part contacts the second component.

10. The switch according to claim 1, wherein the switch comprises a housing, wherein the first stationary contact and the second stationary contact are provided on the housing and the switching mechanism is arranged in the housing.

11. The switch according to claim 10, wherein the housing comprises a lower part and an upper part, wherein the first stationary contact is arranged on an inner side of the upper part.

12. The switch according to claim 10, wherein the housing comprises a lower part and an upper part, wherein the first stationary contact and the second stationary contact are arranged on an inner side of the upper part.

13. The switch according to claim 10, wherein the first temperature-dependent snap-action part is fixed to the movable contact member at a center of the first temperature-dependent snap-action part.

14. The switch according to claim 1, wherein a disc-shaped, plate-shaped or annular support element is arranged locally between the first temperature-dependent snap-action part and the second temperature-dependent snap-action part, wherein the support element comprises a hole through which the movable contact member projects, wherein the second temperature-dependent snap-action part is at least in the second geometric high-temperature configuration supported by the support element.

15. The switch according to claim 14, wherein the switch comprises a housing having an upper part and a lower part, wherein the first temperature-dependent snap-action part is arranged locally between the upper part and the support element, and wherein the second temperature-dependent snap-action part is arranged locally between the support element and the lower part.

16. The switch according to claim 1, wherein the switching mechanism comprises a temperature-independent spring part that is connected to the movable contact member, wherein the movable contact member comprises a movable contact part that interacts with the first stationary contact, and wherein the spring part interacts with the second stationary contact.

17. The switch according to claim 1, wherein the movable contact member comprises a current transfer member that interacts with the first stationary contact and the second stationary contact.

18. A temperature-dependent switch that comprises a first stationary contact, a second stationary contact, and a temperature-dependent switching mechanism having a movable contact member, wherein the switching mechanism, in a first switching position, presses the movable contact member against the first stationary contact and thereby produces an electrically conductive connection between the first stationary contact and the second stationary contact via the movable contact member and, in a second switching position, keeps the movable contact member spaced apart from the first stationary contact, wherein the switching mechanism comprises a first temperature-dependent snap-action part which is fixed to the movable contact member at a center of the first temperature-dependent snap-action part and configured to switch from a first geometric low-temperature configuration to a first geometric high-temperature configuration when exceeding a first switching temperature, and to switch from the first geometric high-temperature configuration back to the first geometric low-temperature configuration when subsequently falling below a first reset temperature, wherein the switch further comprises a second temperature-dependent snap-action part which is configured to switch from a second geometric low-temperature configuration to a second geometric high-temperature configuration when exceeding a second switching temperature, and to switch from the second geometric high-temperature configuration back to the second geometric low-temperature configuration when subsequently falling below a second reset temperature, wherein switching the first temperature-dependent snap-action part from the first geometric low-temperature configuration to the first geometric high-temperature configuration and/or switching the second temperature-dependent snap-action part from the second geometric low-temperature configuration to the second geometric high-temperature configuration brings the switching mechanism from the first switching position to the second switching position, wherein the second reset temperature is lower than the first reset temperature, wherein the second temperature-dependent snap-action part is configured to keep the movable contact member spaced apart from the first stationary contact even if the switch has heated above the first switching temperature and the second switching temperature and has subsequently cooled down to a temperature between the first reset temperature and the second reset temperature, and wherein the second temperature-dependent snap-action part is configured to bring the switching mechanism from the second switching position back to the first switching position when the switch has heated above the first switching temperature and the second switching temperature and has subsequently cooled down to a temperature equal to or lower than the second reset temperature.

* * * * *